US008303209B2

(12) United States Patent
Lewis

(10) Patent No.: US 8,303,209 B2
(45) **Date of Patent: *Nov. 6, 2012**

(54) BREAKAWAY SIGNPOST ADAPTER

(76) Inventor: Donnie G. Lewis, Glendale, KY (US)

( * ) Notice: Subject to any disclaimer, the term of this patent is extended or adjusted under 35 U.S.C. 154(b) by 236 days.

This patent is subject to a terminal disclaimer.

(21) Appl. No.: 12/454,931

(22) Filed: May 26, 2009

(65) Prior Publication Data

US 2009/0302188 A1 Dec. 10, 2009

Related U.S. Application Data

(63) Continuation-in-part of application No. 11/704,887, filed on Feb. 9, 2007, now Pat. No. 7,537,412.

(51) Int. Cl.
*E01F 9/018* (2006.01)

(52) U.S. Cl. ..... 404/10; 40/607.1; 40/612; 248/219.1; 248/548

(58) Field of Classification Search ..... 40/606.01, 40/607.1, 607.11, 612; 404/9, 10; 403/2; 248/218.4, 219.1, 219.3, 548
See application file for complete search history.

(56) References Cited

U.S. PATENT DOCUMENTS

| | | | |
|---|---|---|---|
| 1,677,796 | A | 7/1928 | Parks |
| 4,071,970 | A | 2/1978 | Strizki |
| 4,126,403 | A | 11/1978 | Sweeney et al. |
| 4,607,824 | A | 8/1986 | Krage et al. |
| 4,784,515 | A | 11/1988 | Krage et al. |
| 4,926,592 | A | 5/1990 | Nehls |
| 5,481,835 | A | 1/1996 | Bloom |
| 5,503,495 | A | 4/1996 | Mak et al. |
| D389,252 | S | 1/1998 | Alberson et al. |
| D389,253 | S | 1/1998 | Alberson et al. |
| 5,988,598 | A | 11/1999 | Sicking et al. |
| 6,129,342 | A | 10/2000 | Bronstad |
| 6,254,063 | B1 | 7/2001 | Rohde et al. |
| 6,279,288 | B1 | 8/2001 | Keil |
| 6,398,192 | B1 | 6/2002 | Albritton |
| 6,409,156 | B2 | 6/2002 | Dent |
| 6,422,783 | B1 | 7/2002 | Jordan |
| 6,488,268 | B1 | 12/2002 | Albritton |
| 6,540,196 | B1 | 4/2003 | Ellsworth |
| 6,793,204 | B2 | 9/2004 | Albritton |
| 6,868,641 | B2 * | 3/2005 | Conner et al. ..... 52/98 |
| 6,886,813 | B2 | 5/2005 | Albritton |
| 7,537,412 | B2 * | 5/2009 | Lewis ..... 404/10 |
| 2002/0122693 | A1 | 9/2002 | Jordan |

* cited by examiner

*Primary Examiner* — Gary S Hartmann
(74) *Attorney, Agent, or Firm* — Carrithers Law Office PLLC; David W Carrithers

(57) ABSTRACT

A sectional I-beam post for use along a roadside in which the post has a first elongate lower section securable via a first slip type coupling to a base anchored in the ground. Slip movement of such coupling is in a direction across the length of the post. The first coupling includes L-shaped brackets with one leg thereof attached to the post by bolts so as to be detachable therefrom and notches in the outer end of the other leg which projects outwardly from the post A second elongate upper post section has the lower end thereof connected to the upper end of the first post section by a second slip type coupling. Slip movement of the second coupling is in a direction lengthwise of the post. The second coupling includes an end plate bolted to at least one post section including at least one notch that providing a slip connection with the other post section. A third coupling includes end plates bolted to opposing post sections having a slip plate thereinbetween, each one of the end plates having notches that provide a slip connection between the opposing post sections.

8 Claims, 3 Drawing Sheets

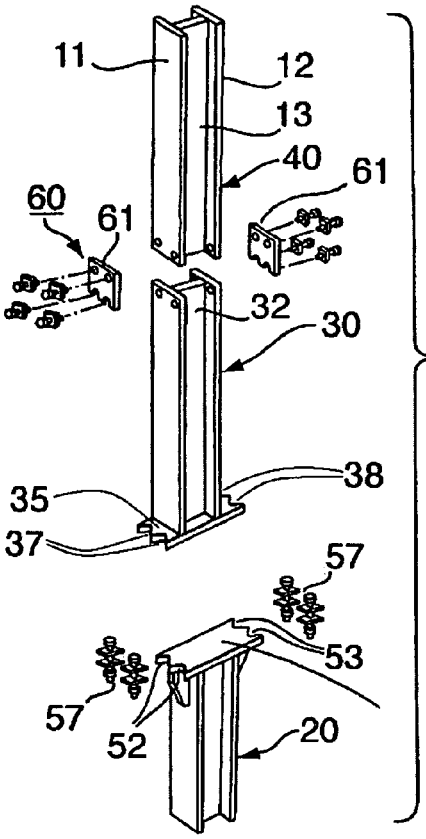
FIG. 8
FIG. 7
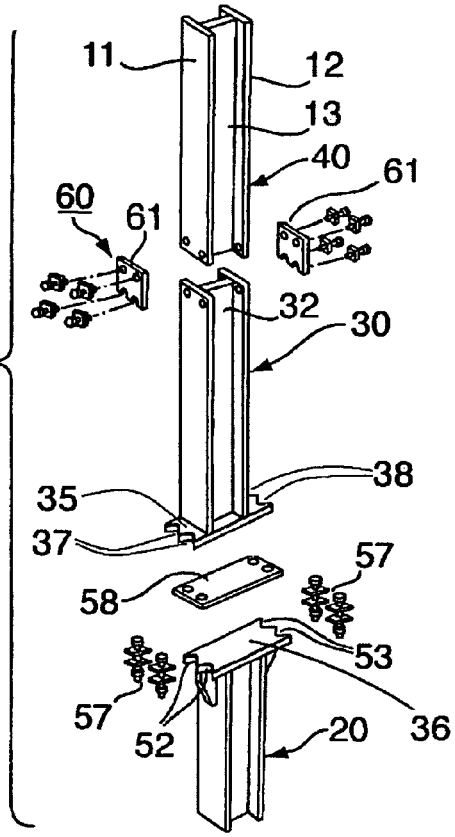
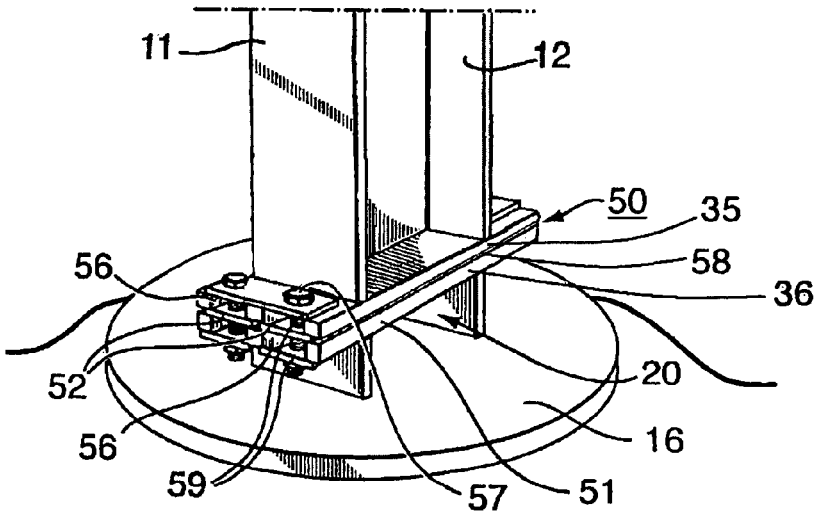
FIG. 9

BREAKAWAY SIGNPOST ADAPTER

RELATED APPLICATIONS

This application is a continuation in part which claims priority from U.S. Pat. No. 7,537,412 which issued on May 26, 2009 from U.S. application Ser. No. 11/704,887 filed on Feb. 9, 2007 and published as U.S. Patent Publication No. 2008/0193200 A1 on Aug. 8, 2008, which is incorporated by reference herein in its entirety.

TECHNICAL FIELD OF THE INVENTION

This invention relates generally to a breakaway coupling interconnecting adjacent post sections including hinge, pivot and slip type couplings.

BACKGROUND OF INVENTION

It is known to have roadside lighting and information bearing panels supported by sectional posts having one or more breakaway couplings interconnection the post sections and that yield upon impact. The breakaway couplings are provided in an attempt to reduce injuries and vehicle damage when the structure is impacted by a vehicle. By way of example reference may be had to the following United States patents: U.S. Pat. No. 4,926,592 issued May 22, 1990 to C. G. Nehls, U.S. Pat. No. 6,488,268 issued Dec. 3, 2002 to J. R. Albritton, U.S. Pat. No. 6,422,783 issued Jul. 23, 2002 to H. M. Jordan, U.S. Pat. No. 5,481,835 issued Jan. 9, 1996 to J. A. Bloom, U.S. Pat. No. 6,540,196 issued Apr. 1, 2003 to S. J. Ellsworth.

U.S. Pat. No. 5,481,835 discloses a tubular highway lamp post with an upper and lower pair of spaced apart break away portions with the lower one being at the base of the post. A road side sign panel supported by multiple posts each with two break away sections spaced apart from one another along the respective posts is disclosed in the following U.S. Pat. No. 4,071,970 issued n Feb. 7, 1978 to R. A. Strizki.

U.S. Patent D389,252 issued on January of 1998 to Alberson teaches a post having a lower post section wecured via slip type coupling means and U.S. Pat. No. 4,126,403 to Sweeney et al. teaches a slip type coupling means but neither teaches or suggest the use of an I-beam arrangement in accordance with the present invention.

Other known post slip type couplings have the components thereof permanently attached to the post sections as for example by welding and in the event of damage to the post not only do the post sections need to be replaced but also the coupling members connecting the same. It is common to see a plurality of stabs or rebar type members projecting upwardly from the ground for supporting sign posts held therein between.

SUMMARY OF INVENTION

The present invention relates generally to posts that are used alongside roadways supporting for example a panel having information for motorists and more particularly to a sectional post for such usage and having slip type break-away couplings spaced apart from one another longitudinally along the post with the direction of slip and to an improved post breakaway coupling.

A sectional I-beam post for use along a roadside in which the post has a first elongate lower section securable via a first slip type coupling to a base anchored in the ground. Slip movement of such coupling is in a direction across the length of the post. The first coupling includes L-shaped brackets with one leg thereof attached to the post by bolts so as to be detachable therefrom and notches in the outer end of the other leg which projects outwardly from the post A second elongate upper post section has the lower end thereof connected to the upper end of the first post section by a second slip type coupling. Slip movement of the second coupling is in a direction lengthwise of the post. The second coupling includes plates bolted to one post section and having notches that provide a slip connection with the other post section. A third coupling includes plates bolted to opposing post sections each one having notches that provide a slip connection between the opposing post sections.

An object of the present invention is to provide a sectional post for use along roadsides in which the post has at least two slip type couplings spaced apart from one another longitudinally along the post with the direction of slip movement of the respective couplings being angularly disposed with respect to one another.

A further object of the present invention is to provide a sectional I beam post for use along roadsides in which there are two or more slip type couplings spaced apart from one another longitudinally along the post A further object of the present invention is to provide a post for roadside use having one or more slip type couplings interconnecting sections thereof in which components of the coupling are separate elements that are detachably secured to the post section associated therewith.

In keeping with the foregoing there is provided in accordance with one aspect of the present invention a sectional post for use along a road side, with the post having a first elongate lower section securable via a slip type coupling to a base anchored in the ground and in which the direction of slip movement of such coupling is in a direction across the length of the post. Also included is a second elongate upper section and a second slip type coupling detachably interconnecting the first and second sections in end-to-end relation and wherein the direction of slip movement of the second coupling is in a direction lengthwise of the post. The second coupling includes plates bolted to one post section and having notches that provide a slip connection with the other post section. A third coupling includes plates bolted to opposing post sections each one having notches that provide a slip connection between the opposing post sections and wherein the direction of slip movement of the third coupling is in a direction lengthwise of the post.

In accordance with another aspect of the present invention there is provided a post for use along a roadside. The post comprises a first lower I-beam post section, a second intermediate I-beam post section, and a first slip type coupling means interconnecting said post sections in end-to-end relation. The first coupling means comprises a pair of plates, one permanently attached to the lower end of the lower post section ant the other permanently attached to the top of the base section of the post. The pair of plates are in a face-to face relation in a horizontal plane with each such plate having notches in a free outer end thereof remote from the post, bolt and nut units interconnecting the plates with the bolt portion thereof passing through a notch in an upper one of the plates that is aligned with a notch in the lower plate. The notches permit slip in which the slip movement is in a direction across the length of the post. Included also is an upper post section and a second slip type coupling means interconnecting the intermediate and upper sections in end-to-end relation and wherein slip movement of the second coupling is in a direction lengthwise of the post.

In accordance with still another aspect of the present invention there is provided a post for use along a roadside. The post comprises a first lower I-beam post section, a second intermediate I-beam post section, and a first slip type coupling means interconnecting said post sections in end-to-end relation. The first coupling means comprises a first and second lower and upper pair of L-shaped brackets removably secured respectively to the lower and intermediate post sections. The pairs of brackets have legs thereof in face-to face relation in a horizontal plane proximate abutting ends of the post sections with each such bracket having notches in a free outer end thereof remote from the post, bolt and nut units interconnecting said pairs of brackets with the bolt portion thereof passing through a notch in an upper one of the brackets that is aligned with a notch in the lower bracket. The notches permit slip in which the slip movement is in a direction across the length of the post. Included also is an upper post section and a second slip type coupling means interconnecting the intermediate and upper sections in end-to-end relation and wherein slip movement of the second coupling is in a direction lengthwise of the post.

Other objects, features, and advantages of the invention will be apparent with the following detailed description taken in conjunction with the accompanying drawings showing a preferred embodiment of the invention and appended claims.

BRIEF DESCRIPTION OF THE DRAWINGS

A better understanding of the present invention will be had upon reference to the following description in conjunction with the accompanying drawings in which like numerals refer to like parts throughout the several views and wherein:

FIG. 7 is an exploded oblique view of the post showing the upper slip type coupling interconnection the upper and intermediate post sections and a plate permanently mounted on the bottom of an intermediate post portion and the top of a lower post section;

FIG. 8 is the sectional post as in FIG. 7 with an additional end plate included in the lower assembly; and FIG. 9 is an oblique view, on a larger scale, of the anchored base portion and a lower slip type coupling using a pair of end plates connecting the post to the base wherein the end plates include a slip plate disposed thereinbetween connecting the respective lower and base end plate portions.

DETAILED DESCRIPTION OF PREFERRED EMBODIMENT

Figure 1:
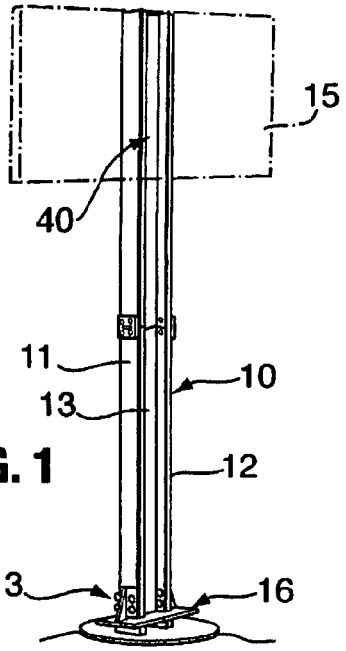
FIG. 1 is an oblique view of an I-beam post anchored in the ground and in which the post is composed of post sections interconnected end-to-end by two spaced apart slip type couplings.
Figure 2:
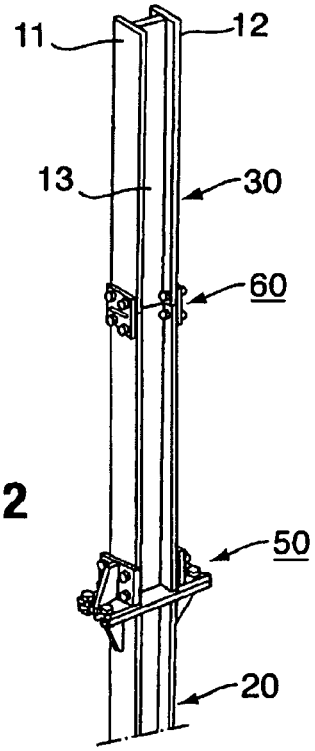
FIG. 2 is an oblique view of the sectional post shown in FIG. 1.

Illustrated in the drawings is a post 10 having a member 15 mounted thereon. The member 15 is shown in broken line and is representative on any one of a panel that bears information along a roadway for motorists or lighting. It is to be understood applicants post can have many different use applications that may require one or more posts.

The post 10 is preferably made from wide flange I-beam elongate sections that have spaced apart flanges 11, 12 interconnected by a web 13. The post comprises a base section 20, an intermediate section 30 and an upper section 40 with such post sections being connected in end-to-end relation by first and second respective lower and upper breakaway couplings 50 and 60.

Figure 3:
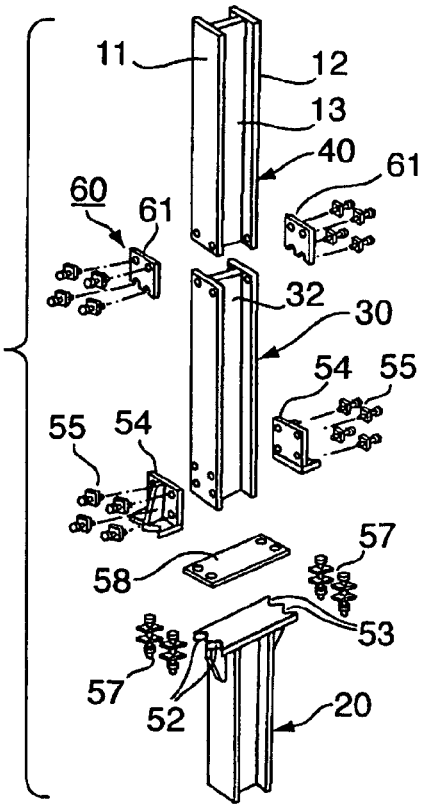
FIG. 3 is an exploded oblique view of the post showing the individual components.

In FIG. 1 the base section 20 is shown partially embedded in concrete 16 in the ground and has a portion projecting upwardly therefrom terminating at the upper end in a horizontally disposed end plate 36 (see FIGS. 3,4) that is fixedly secured thereto. The end plate 36 projects beyond the respective flanges 11, 12 of the I-beam and has a first spaced apart pair of notches 52 in one end thereof and a second spaced apart pair of notches 53 in the other end opposite to said one end.

As shown in FIGS. 2,3, 5, and 6, the intermediate post section 30 has four holes 31 in each of the flanges 11, 12 proximate the lower end thereof and two holes 32 proximate the opposite upper end. One L-shaped bracket 54 is secured by four bolt and nut units 57 to the flange 11 and another bracket 54 is similarly secured to the flange 12. Each bracket 54 has four holes in one leg thereof and a pair of spaced apart notches 56 in the other leg. The notches 56 in the pair of brackets 54 align with the notches 52, 53 in the end plate 36 for receiving a respective one of four bolt and nut units 57. These bolt and nut units 57 are suitably positioned by holes disposed in predetermined locations in a slip plate 58 that is positioned between the lower end of the post section 30 and the end plate 36 on the base section 20.

Figure 6:
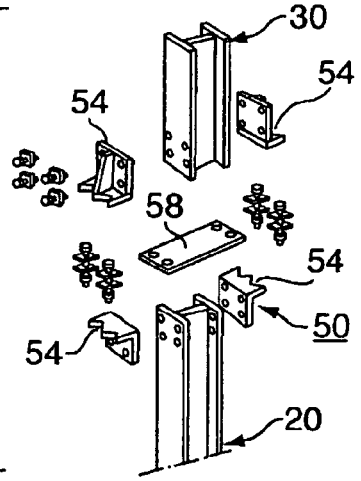
FIG. 6 is an oblique view illustrating a lower slip coupling using L-shaped brackets.
Figure 4:
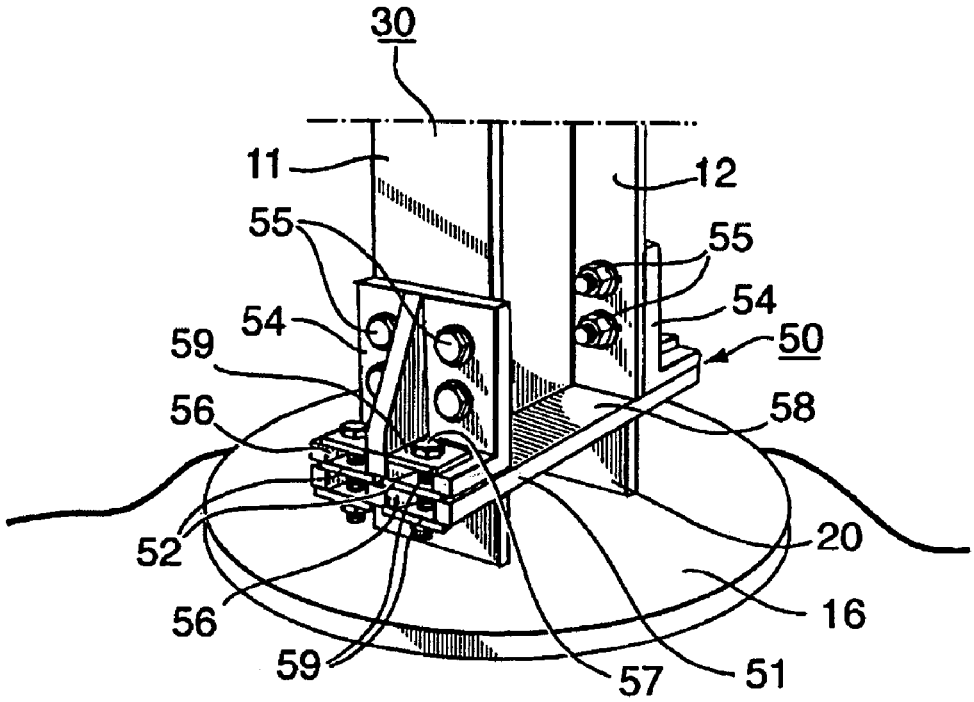
FIG. 4 is an oblique view, on a larger scale, of the ground anchored base portion and lower slip type coupling using a pair of plates connecting the post to the base.
Figure 5:
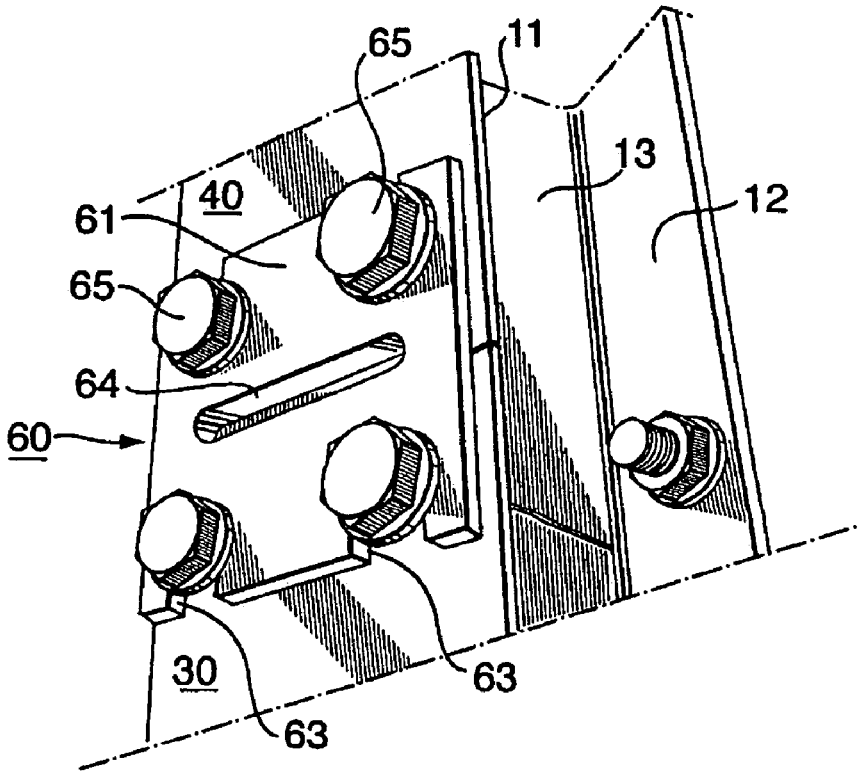
FIG. 5 is an oblique view, on a larger scale, of a portion of the post showing the upper slip type coupling interconnection the upper and intermediate post sections.

As seen in FIG. 4 there are two washers 59 on each bolt of the bolt and nut units 57 with one washer overlying the notch 56 in the bracket 54 and the other underlying the notch 52, or 53 as the case maybe, associated therewith in the end plate 36. If desired two brackets 54, as illustrated in FIG. 6, can be connected to the base post section 20 to replace the above described end plate 36 thereby permitting ready replacement of any one of the components that makes up the slip coupling 50.

The slip coupling 60 is provided by a pair of plates 61 one being on the outer face of the flange 11 and the other on the outer face of flange 12. Each plate has two holes disposed adjacent one end thereof and a pair of spaced apart notches 63 extending inwardly from the opposite end of the plate. The upper post section 40 has two spaced apart bolt receiving holes 41 adjacent the lower end thereof and two bolt and nut units 65 attach one plate 61 to flange 11 of the upper post section 40 and similarly the second plate 61 is to the flange 12. The pair of plates project downwardly from the upper post section and overlap an upper portion of the post section 30. The notches 63 in the pair of plates 61 are disposed in preselected alignment with the bolt holes 32 in the upper end of the post intermediate section 30 and have the bolt portion of bolt and nut units 67 pass there through.

Each plate preferably has a line of weakness approximately mid-distance between the holes and the notches 63 and this line of weakness is provided in the preferred embodiment by a slot 64 in the plate The two holes in the plate and the holes 41 in the post section are preferably so located as to position the line of weakness in the plate in a plane that passes approximately between the adjacently disposed abutting ends of the post sections 30, 40.

The amount by which the bolt and nut units 57 are tightened predetermines the amount of force required to break the respective couplings 50 and 60. The coupling 60 can be partially broken by having the notches 63 disengage from the bolt and nut units 57 on flange 11 or on flange 12 but not on the other. In such instance the line of weakness in the plate that remains connected to the post section 30 provides a hinge allowing the upper post section 40 to become angularly disposed with respect to the intermediate post section 30. Complete breakage of the coupling 60 occurs when the notches 63 in both plates become disengaged from the bolt and nut units 57 associated therewith.

As shown in FIGS. 7 and 8, the second or intermediate elongate upper post section has the lower end thereof connected to the upper end of the bottom post section by a second slip type coupling. Slip movement of the second coupling is in a direction lengthwise of the post. The second coupling includes end plates bolted to opposing post end sections and having notches that provide a slip connection between the other post section.

In FIGS. 7 and 8 intermediate post section 30 has and end plate 35 permanently attached at the bottom end in a horizontal plane. End plate 35 has pairs of notches 37 and 38 at respective ends. Base section 20 has an end plate 36 permanently fastened to its upper end. End plate 36 has pairs of corresponding notches 52 and 53 at its respective ends. End plates 35 and 36 are held together in face-to-face relationship with bolt and nut units 57.

As best shown in FIG. 8, another preferred embodiment, a greater strength is required for the first coupling 50. Bolt and nut units 57 are suitably positioned by holes disposed in predetermined locations in a slip plate 58 that is disposed between the lower end of the post section 30 and the end plate 36 on the base section 20. Bolt and nut units 57 comprise bolts which will shear when a large enough force is applied. Thus, when adding the frictional force between the end plates 35, 36 and slip plate 58 disposed there between to the strength of the shear bolts, an overall greater strength for the first coupling 50 is accomplished.

The third coupling includes end plates bolted to opposing post sections each one having notches that provide a slip connection between the opposing post sections together with a slip plate 58 disposed there between. Providing slip movement of the coupling in a direction lengthwise to the post.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplifications presented herein above. Rather, what is intended to be covered is within the spirit and scope of the appended claims.

I claim:

1. A post for use along a roadside comprising:

a first lower post section securable via a first slip type coupling means to a base section anchored in the ground and in which the slip movement of such coupling is in a direction across the length of the post;

a second upper post section;

a second slip type coupling means interconnecting said first and second sections in end-to-end relation and wherein slip movement of said second coupling is in a direction lengthwise of the post, said post sections comprising elongate I-beam sections; and said second coupling means comprises a first pair of plates located one on each of respective outer faces of the flanges of the I-beams, means securely removably anchoring a portion of the respective plates to the post flange associated therewith of one post section and slip joint means connecting another portion of said first plate to the flange associated therewith of the other adjacently disposed post section and wherein said first coupling means includes a second pair of plates, one of said second pair of plates fixedly attached in a horizontal plane to a lower end of the lower post section and the other of said second pair of plates fixedly attached in a horizontal plane to a top end of said base section, each of said second pair of plates projecting outward of said post section and said base section and having at least one notch in a free outer edge, said second pair of plates being held in a face-to-face relationship with bolt and nut units having the bolt thereof passing through said notches and thereby permitting slippage and subsequent detachment.

2. The post as defined in claim 1 wherein a third plate is inserted between said second pair of plates within said first coupling, said third plate containing holes which align with said notches and said bolt and nut units comprising shear bolts.

3. A post for use along a roadside comprising:

a first post section securable via a first slip type coupling means to a base section anchored in the ground and in which the slip movement of said first slip type coupling means is in a direction across the length of said post;

a second post section;

said first post section and said second post section comprise elongate I-beam sections having opposing outer faces;

a second slip type coupling means interconnecting said first post section and said second post section in end-to-end relationship wherein slip movement of said second post section coupling is in a direction lengthwise of said post;

said second coupling means comprises a pair of plates located one on each of respective outer faces of the flanges of the I-beams, means securely detachably anchoring a portion of the respective plates to the post flange associated therewith of one post section and slip joint means connecting another portion of said plates to the flange associated therewith of the other adjacently disposed post section;

said plates have a line of weakness approximately mid-distance between upper and lower anchoring points providing hinge or breaking point when the opposing slip joint plate has become disconnected; and said line of weakness comprising a horizontal slot in said plates.

4. The post as defined in claim 3 wherein said first coupling means includes a pair of L-shaped brackets, means removably securing one leg of the respective brackets to respective ones of the flanges of the lower end of the lower post section with the other leg projecting outwardly away from the post flange associated therewith, each of said projecting bracket leg having at least one notch extending inwardly from a free outer edge thereof and bolt and nut units on said base section having the bolt thereof passing through said notches and thereby permitting slippage of the coupling.

5. The post as defined in claim 4 wherein said notches are located in a free outer end of the bracket associated therewith.

6. The post as defined in claim 5 wherein a third plate is inserted between said L-shaped bracket legs held in a face-to-face relationship, said third plate containing holes which align with said notches in said legs and said bolt and nut units comprising shear bolts.

7. A post for use along a roadside, said post consisting essentially of:

a first lower I-beam post section anchored in the ground, a second intermediate I-beam post section, a first slip type coupling means interconnecting said post sections in end-to-end relation, said first coupling means comprising a first and second lower and upper pair of L-shaped brackets removably secured respectively to said lower and intermediate post sections, said pairs of brackets having legs thereof in face-to face relation in a horizontal plane proximate abutting ends of said post sections, each such bracket having notches in a free outed end thereof remote from the post, bolt and nut units interconnecting said pairs of bracket with the bolt portion thereof passing though a notch in an upper one of the brackets that is aligned with a notch in the lower bracket, said notches permitting slip in which the slip movement is in a direction across the length of the post;

an upper post section;

a second slip type coupling means interconnecting said intermediate and upper sections in end-to-end relation and wherein slip movement of said second coupling is in a direction lengthwise of the post.

said second coupling means comprises a pair of plates located one on each of respective outer faces of the flanges of the I-beams, means securely detachably anchoring a portion of the respective plates to the post flange associated therewith of one post section and slip joint means connecting another portion of said plates to the flange associated therewith of the other adjacently disposed post section;

said plates having a line of weakness approximately mid-distance between upper and lower anchoring points providing hinge or breaking point when the opposing slip joint plate has become disconnected; and said line of weakness comprising a horizontal slot in said plates.

8. The post as defined in claim 7 wherein a third plate is inserted between said L-shaped bracket legs held in a face-to-face relationship , said third plate containing holes which align with said notches in said legs and said bolt and nut units comprising shear bolts.

* * * * *